United States Patent [19]

Cloosterman

[11] Patent Number: 4,826,008

[45] Date of Patent: May 2, 1989

[54] TRANSPORT PACK

[75] Inventor: Johannes H. G. Cloosterman, Zwartebroek, Netherlands

[73] Assignee: Chemco Soest BV, Soest, Netherlands

[21] Appl. No.: 160,709

[22] Filed: Feb. 26, 1988

[30] Foreign Application Priority Data

Feb. 27, 1987 [NL] Netherlands ..... 8700497

[51] Int. Cl.[4] ..... B65D 85/67

[52] U.S. Cl. ..... 206/413; 206/407; 206/415; 220/73; 220/304; 229/5.7

[58] Field of Search ..... 206/407, 408, 415, 413, 206/414, 416, 446; 220/73, 293, 304, 355, 356; 229/5.7, 93

[56] References Cited

U.S. PATENT DOCUMENTS

| | | | |
|---|---|---|---|
| 868,850 | 10/1907 | Eckart | 220/355 |
| 1,114,660 | 10/1914 | West | 206/407 |
| 1,225,876 | 5/1917 | Silk | 220/73 |
| 1,256,933 | 2/1918 | Schriner | 220/73 |
| 2,474,657 | 6/1949 | Corson | 206/407 |
| 2,889,921 | 6/1959 | Hubbard | 206/408 |
| 2,977,993 | 4/1961 | Scherer | 220/356 |
| 3,165,227 | 1/1965 | Crowell et al. | 220/355 |
| 3,228,579 | 1/1966 | Dong et al. | |
| 3,260,362 | 7/1966 | Schwinne | 206/415 |
| 3,412,847 | 11/1968 | Wise | |
| 3,768,641 | 10/1973 | Jerzewski Jr. | |
| 3,944,148 | 3/1976 | Freeman et al. | 206/407 |
| 4,058,216 | 11/1977 | Tsuyuguchi | 206/416 |
| 4,133,560 | 1/1979 | Ishikawa et al. | 220/293 |
| 4,146,207 | 3/1979 | Rofe | 220/304 |
| 4,202,462 | 5/1980 | Imber | 220/293 |
| 4,245,753 | 1/1981 | Ellis | 210/304 |
| 4,305,535 | 12/1981 | Brundige et al. | 229/5.7 |
| 4,346,832 | 8/1982 | Werner | 229/4.5 |
| 4,491,238 | 1/1985 | Tobolt | 220/355 |
| 4,516,688 | 5/1985 | Freeland | 220/293 |
| 4,671,409 | 6/1987 | Espy | 206/407 |
| 4,674,650 | 6/1987 | Hamilton et al. | 220/355 |

FOREIGN PATENT DOCUMENTS

| | | |
|---|---|---|
| 551178 | 10/1956 | Belgium . |
| 1561893 | 4/1970 | Fed. Rep. of Germany . |
| 2101399 | 3/1972 | France . |
| 2224361 | 10/1974 | France . |
| 2309898 | 11/1976 | France . |
| 2540078 | 2/1983 | France . |

*Primary Examiner*—David T. Fidei

*Attorney, Agent, or Firm*—Dennison, Meserole, Pollack & Scheiner

[57] ABSTRACT

A package for light sensitive materials, such as photographic film, generally includes a cylindrical body fabricated from wound paperboard or plastic and includes a closure member at each end to define a light excluding container. The body of the container includes end rings affixed to the body and capable of receiving either a fixed or a removable closure at each end. The ring is permanently attached to the cylindrical body and may provide cooperating means for receiving a removable closure on either or both ends of the container. A closure is removably secured to at least one end of the container by interengagement with cooperating threads or a bayonet joint. Each closure, whether permanent or removable, also includes a centering device which extends into the core of the wound film package and supports the film in a position out of contact with the interior of the container. A cooperating sealing device between the ring and the closure is provided to insure positive light exclusion from the interior of the package.

7 Claims, 2 Drawing Sheets

TRANSPORT PACK

BACKGROUND OF THE INVENTION

The invention relates to a pack, in particular for sensitive material wound to a roll on a rigid core, having a width between wide limits, comprising a stiff circular-cylindrical tube with closing means which are disposed at right angles to the central axis, and at least one of which is detachably fixed, both closing means of each pack being provided with centering means for the core of the roll, such that the wound roll material in all positions of the pack is exclusively carried by the core on the centering means and nowhere along its circumference touches the pack.

Packs of the type described above are known from the French Patent Specification No. 2,224,361. It is therefore surprising that it is still a regular occurrence for rolls of wound sensitive material for transport and/or storage to be even less efficiently packed than with the known simple tubes. Although the invention is not expressly limited to it, the commonly used pack for rolls of light-sensitive photosetting material will be discussed as an example. The manufacturer packs the rolls individually in lightproof and moisture-proof film and places this unit in a cardboard box. When it arrives at the user's, the pack must be opened and the film removed in complete darkness, and the roll must then be placed in the photosetting machine. It is then found that the roll cannot be placed in the photosetting machine because the roll and core have become oval during transportation and/or storage, or the material on the roll is damaged, in particular at the corner edges, so that the photosetting machine refuses to work or the results is poor type-setting, inter alia because the material is damaged or is not flat. It is known per se to place the rolls in lightproof cassettes at the manufacturer's, to send them, and then to place the complete cassette in the photosetting machine. These cassettes are, however, relatively expensive. Another disadvantage is that many types and sizes of photosetting machines are used in practice, using rolls of material with roll widths and material web varying between about 5 and 125 cam and more. The diameter of the rolls for the majority of the photosetting machines is about 15 cm or less. With this great diversity occurring in practice, the cassettte system is therefore not flexible enough.

It follows from the above that there is, surprisingly, a need for packs for fragile rolls of wound, sensitive material which can be adapted in a flexible way to the various known and future sizes, and which are preferably so simple that they can be regarded as disposable packs. They must also be easier to use for the manufacturer and the user.

SUMMARY OF THE INVENTION

The object of the invention is then to produce a suitable pack with which the above-described disadvantages are avoided and the envisaged objective is achieved.

According to the invention, the pack described in the preamble is to this end characterized in that:

the length of the tube is substantially equal to the width of the material wound into the roll for which the pack concerned is intended to be used, at each end a stiff end ring is fixed in clamping fashion over the end edge of the tube, as closing means a closed bottom is or can be fastened to the end ring, when assembled, the centering means for the core of the roll are formed by a cylindrical tongue, projecting inwardly from each bottom, and running concentrically with the central axis of the tube, and which is of such external diameter and length that it fits with slight clearance into cavities in the ends of the core and, when the pack is closed, projects into the cavities over a distance of about a few centimeters.

What is essential in the above-described pack is the fact that the roll of material is supported only via the core on which the material is wound, by the tongues which project at both ends in the central axis into the tube. Consequently, whatever the position of the pack, the periphery of the roll cannot anywhere come into contact with the inside of the tube and thereby be damaged. Since the roll is always supported in the centre of the pack, the end faces of the roll cannot be damaged either through contact with the bottoms, since they are always parallel to each other.

By taking as the starting material commercially available, for example cardboard, tubes of sturdy quality which are provided with a moisture-resistant layer, ends cut off as desired to the correct length of the tube can be produced and adapted to the width of the roll of wound material to be packed. This greatly simplifies the purchase and stocking of the base material. In many cases tubes with an internal diameter of about 16 cm will be sufficient, while consideration can be given to use packs adapted in diameter only in the case of large orders for rolls with smaller diameter. The most common widths of rolls between 10 cm and 125 cm can therefore easily be spanned using the purchased tubes with a length of a few metres. Thanks to the limitation of the tubes used to one diameter and, by way of exception, a second diameter, the variety of end rings and bottoms can also be limited, so that both die costs and manufacturing costs, but also stocks, can also be limited. The same end rings and the same bottoms can be used for packs of all desired lengths. Of course, the end rings are fastened in clamping fashion —and thus lightproof and moisture-proof—over the end edges of the tube.

The cores used need only have cavities at each end which fit over the tongues. In general, a rigid cardboard tube is used for the cores, but any type of core is possible, even a solid one, provided that the above-mentioned cavities are present in each end. The roll is supported in the pack by means of the tongues inserted into said cavities.

In order to ensure that the cutting of each tube to the correct length from the long rolls of tubular base material is not too critical, and thus to permit a wide tolerance, it is advantageous according to a preferred embodiment of the invention for each tongue to have placed around it a thin, elastic, annular disc, for example of foamed plastic, which lies between the inside of the bottom and the end face of the wound roll when the pack is closed. The axial confinement of the roll between the thin annular discs of foamed plastic means that length tolerances of the tubes and thus of the assembled packs can easily be spanned. It also prevents the rolls from being able to move to and fro in the axial direction in the packs. Of course, the chance of damage to the rolls is small, but taking away this risk entirely is an advantage. Inadmissible telescoping of the roll is also prevented.

It has already been mentioned that the tube is provided with an end ring rigidly attached thereto, because it is practically impossible to fix a detachable bottom directly on a tube of, for example, cardboard material. Since the pack has to be closed when a roll is placed in it, and it must be possible to open it again in complete darkness at the user's, it is advantageous for at least one of the bottoms to be in the form of a cover, and such that it can be fitted by means of a detachable connection, such as a screw thread or bayonet connection, over the appropriate end ring, which is provided with corresponding connecting means. It is clear that both ends of the tube can be closed in this way with a cover. The use of the end ring/cover combination makes for much greater userfriendliness, because full opening and closing are greatly simplified. If desired, a safety closure which is known per se can be fitted by the manufacturer to lock the tightened cover relative to the end ring. Only when the said safety closure is broken can the user loosen the cover.

However, in a number of cases it is sufficient if only one detachable cover is used, so that the other end of the tube is permanently closed. For this, according to another preferred embodiment, the said bottom is permanently fixed to the end ring concerned. The said bottom with the central tongue can be integral here with the said end ring, but it is also possible to attach the bottom to the end ring, for example by welding or gluing.

A number of other advantageous embodiments are mentioned in the sub-claims and discussed in the description with reference to the figures below.

In the case where one or both covers have a bayonet closure which always has a small number of discrete closing positions, for example at 45 or 90 or 180 degrees, a preferred embodiment is characterized in that the end cover has an octagonal periphery, and the fitting of the end ring and/or the closed end cover is such that the faces of the octagon at each end of the tube lie in corresponding cylinder faces. This makes it possible for the packs to be stackable, and they cannot roll. If the detachable connection were to be provided with screw thread, the octagonal design would also be usable in theory, particularly if a multiplex thread with steep pitch is used, but is generally known that a bayonet connection is preferable in order to achieve the desired correct alignment of the two octagons relative to each other. Besides, a bayonet connection is easier to use than a screw-thread connection. It can further be pointed out that hexagonal covers can also be used. However, it is preferable to have the central axis of the roll in a horizontal position during both transport and long-term storage. A horizontal stacking of the tubes with hexagons is possible, but this has the disadvantage that such stackings have to be confined sideways because, owing to their weight, they have a tendency to push each other apart. Octagonal, or possibly square, end covers do not give this problem when stacked, and they are therefore preferable.

Since the tongues are relatively large in volume, they will preferably be hollow on the inside. In this case, according to a preferred embodiment, this cavity can be connected by means of screened openings to the inside of the tube, the cavity in the region of the end face of the end cover being fully closable, so that, for example, a drying agent such as silica gel can be placed in the cavity.

It has already been mentioned earlier that the pack according to the invention is usable generally, but when it is used for the transportation and the storage of, for example, rolls of light-sensitive photosetting material, an attractive process for filling of the packs in complete darkness is characterized in that:

two detachable end covers are placed open side up on a horizontal surface, the end rings with bayonet or screw thread are secured on the covers, an elastic ring disc is placed around the tongue of each cover, one of the combined cover/end ring/ring disc assemblies is placed on a horizontal surface with at least one of the side faces of the cover resting against one or more vertical stop faces positioned at an angle, a wound roll is placed round the tongue on this combined cover/end ring/ring disc assembly, the tube, of the right length, is lowered in the vertical position over the wound roll and is then positioned on the ring, the second combined cover/end ring/ring disc assembly with the tongue downwards is positioned on the tube with at least one of the side faces of the cover against the vertically placed stop faces(s), the whole pack is assembled by means of one vertical downward movement (ram), in which the end edges of the tube are pressed completely into the corresponding grooves of the end rings.

Since the tube according to this process is already pre-assembled and closed on one side, the pack can be made by the above-mentioned small number of simple actions. This is, of course, of additional benefit if one has to work in complete darkness.

Naturally, the material to be used for the tube, the end rings and the covers must be neutral and inert relative to the product to be packed.

The pack will be explained in greater detail by the description which follows with reference to the attached figures of embodiments of the pack according to the invention.

PREFERRED EMBODIMENTS

Figure 1:
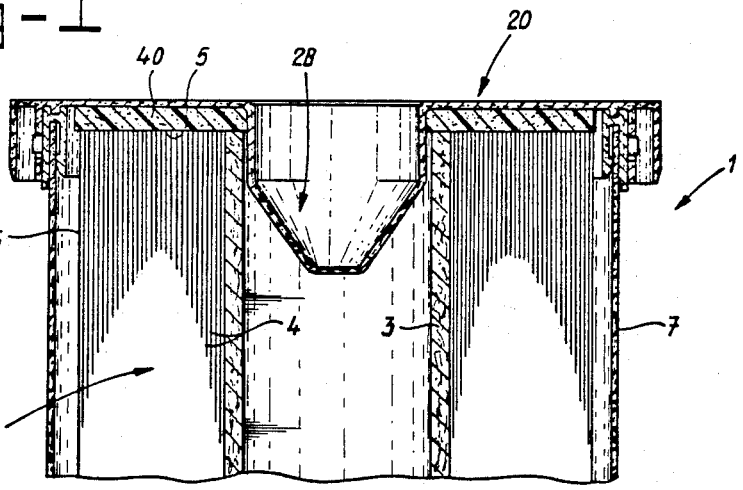
FIG. 1 shows a part of a lengthwise section of a pack according to the invention, filled with a material wound to a roll on a core.

A pack according to the invention is indicated in its entirety by 1. It is for the safe packing and storage of a sensitive material, for example light-sensitive photosetting material, wound to a roll 2. The roll 2 is wound in a large number of layers 4 onto a rigid core 3 which can be made of, for example, rigid cardboard or plastic. FIG. 1 shows the core as a hollow tube, but it can also be solid and have cavities disposed at both ends, a subject which will be reverted to later. After manufacture, packing, despatch and possible storage, such a roll is taken out of the pack at the user's and placed in, for example, a photosetting machine. The material is for this purpose wound tightly and accurately onto the core, so that the end faces 5 lie completely flat and at right angles to the central axis of the roll, while the outside surface 6 is also completely smooth and virtually circular. The object of the pack is safe transportation and storage of the sensitive material, so that, despite rough transport, it arrives undamaged at the user's, combined with ease of use. To this end, the pack is formed by a tube 7 of rigid material which is suitable for the purpose, such as coated cardboard or plastic. The roundness of the tube 7 is to a great degree favourably affected by the closing means on both ends which will be discussed later on, so that the wall thickness of the tubular material 7 can be relatively low, but is sufficient to take knocks during transportation without ever touching the outside surface 6 of the roll. For this, there is a wide gap between the outside surface 6 of the roll and the inside surface of the tube 7. The length of the tube 7 is substantially equal to that of the roll and thus the width of the material wound to a roll.

Figure 2:
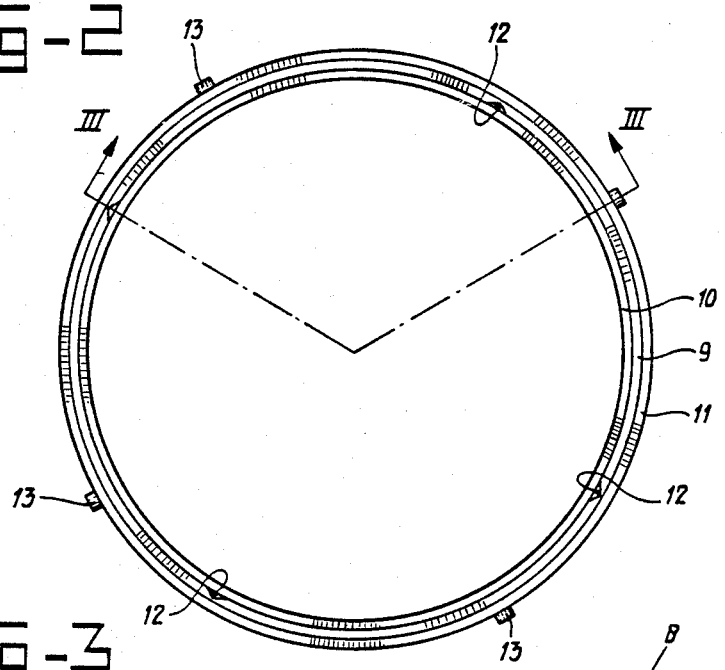
FIG. 2 shows a bottom view of an end ring according to FIG. 3.
Figure 3:
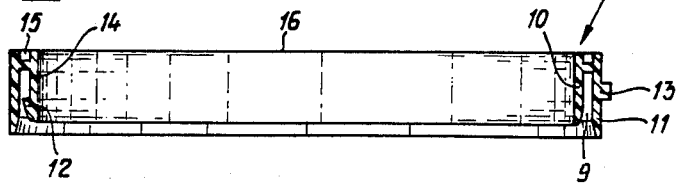
FIG. 3 shows a cross section along the line III—III of FIG. 2.

An end ring 8 is disposed at each end of the tube 7, as shown in FIGS. 2 and 3. This end ring 8 has an annular groove 9, which is surrounded on either side by circular walls 10 on the inside and 11 on the outside. The groove 9 is of the same diameter and width as the diameter and wall thickness of the tube 7, so that the end ring 8 with its groove 9 can be pushed over the end of the tube 7. The dimensioning is such that the end ring must be pushed with force over the end of the tube 7, so that the connection is tight, both against moisture and against light. Since, once mounted, an end ring must not be too easy to remove from the tube, it can be provided with a number of wedges 12 which project over the periphery in the groove 9, and which are shaped in such a way that the tube can be easily pushed over them during fittings, but that removal is hampered because the wedges 12 become stuck in the tube material. It will be clear to the expert that, instead of a number of individual wedges 12 mounted on the inside of the tube, it is also possible to use alternately placed wedges, or for example circular barb-type ribs. The inside wall of the end ring is of such material thickness that the inside surface 14 remains sufficiently far away from a packed roll of material, as FIG. 1 shows. As FIG. 3 shows, the inlet sides of the groove 9 can both be rounded and provided with a locator, so that the fitting of the tube 7 in the groove 9 is facilitated. A concentric groove 15, whose function will be discussed later on, is provided opposite the groove 9, thus at the free end of an end ring 8 provided on a tube 7.

Since it is necessary to be able to close and open the pack, at least one of the closing means has to be detachable. The other can remain closed. According to a preferred embodiment not shown, the end ring 8 shown in FIG. 3 can be provided with a welded-on or, for example, glued-on bottom, which is schematically indicated by 16. In such an embodiment the end ring 8 also forms a totally permanent closure on that side of the tube 7. The bottom 16 has on the inside a tongue 28, as will be explained in greater detail below.

Figure 4:
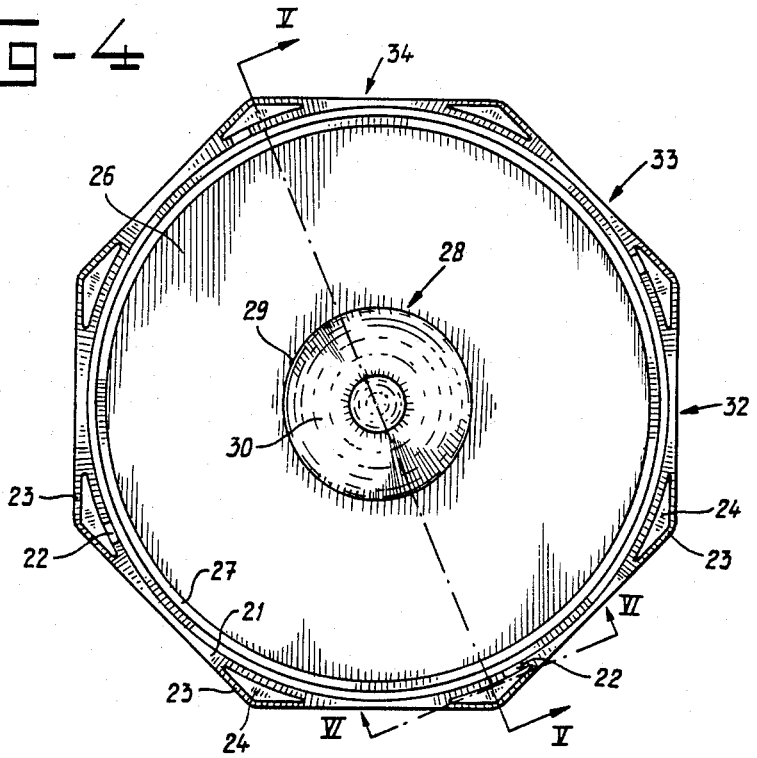
FIG. 4 shows a bottom view of a closing cover for mating with the end ring according to FIGS. 2 and 3.
Figure 5:
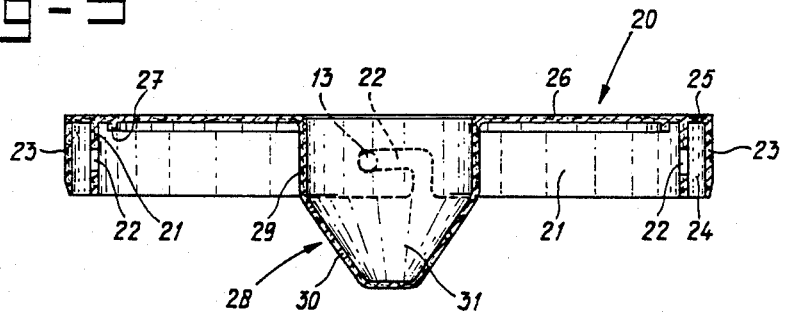
FIG. 5 shows a cross section along the line V—V of FIG. 4.
Figure 6:
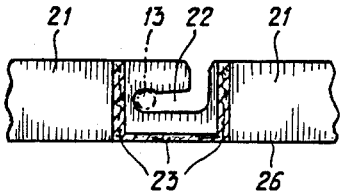
FIG. 6 shows partially in section a detail along the line VI—VI of FIG. 4.

FIGS. 4, 5 and 6 show a detachable closure of the type which has to be used on at least one end of the tube 7. The detachable cover 20 comprises a bottom 26, which is provided with a circular, upright edge 21. The latter slides over the external surface of the end ring 8. A tongue 28 with a cylindrical periphery 29 projects upwards from the bottom 26 in the cover, concentrically with the central axis, so that when the cover is fitted on the tube said tongue projects over some distance concentrically with the central axis in the tube 7. The external surface of the tongue 28 is of such length and diameter that it carries the core of the wound roll of material and thus prevents the external surface of the material 6 from ever touching the tube 7. In order to facilitate fitting, the tongue 28 is provided with a locator 30. It has already been said earlier that the core 3 of the roll 2 must have a sufficiently large cavity at least on both ends for it to be capable of taking the tongue 28.

According to the preferred embodiment shown, the fastening of the detachable cover 20 on the end ring 8 concerned takes place by means of a bayonet closure, a fourfold one. For this, according to FIGS. 2 and 3, the end rings are provided with four cams 13 projecting outwards and evenly distributed over the periphery. These have to mate with the elbow-shaped bayonet slots 22 which are provided in the circular wall 21 of the cover 20, and which are formed in the usual way and provided with a raised part to prevent undesirable opening when locked. The bayonet slots 22 are shown in FIGS. 4, 5 and 6, while one of the cams 13 is shown in the locked position by dotted lines in FIG. 6. A circular, concentric ridge 27 corresponding to the annular groove 15 in the front face of the end ring 8 is shown in FIGS. 4 and 5 and fits tightly into the groove 15. Its purpose is further to improve the tightness to moisture and light. It is also possible to lay an O-ring of an elastic material on the bottom of the groove 15, on which in the locked state the ridge 27 presses to give a further improvement of the tightness.

It can also be seen in FIGS. 4, 5 and 6 that the essentially circular cover 20 is provided along its periphery with eight flat faces 32, 33, 34 which all form an angle of 45 degrees with each other. With a view to correct functioning and good manufacture of the bayonet slots 20, and in order to save material, the corners between the flat faces 32, 33 and 34 are provided with a cavity 24, which at 25 is closed by the bottom 26. This makes it difficult for dirt to enter the cavities 24. The walls of the corners are indicated by 23, as can also be seen from the section shown in FIG. 6.

If only one of the end closures of the pack is provided with a detachable cover according to FIGS. 4, 5 and 6, the position of the cover 32 and of the end ring 8 relative to the tube does not matter. If, however, both ends of the tube 7 are provided with an end cover 20 with flat sides, then it is necessary for both end rings 8 to be fitted in such a position relative to each other on the tube 7 that, after fitting, i.e. after counterrotation relative to the tube to lock the bayonet closure, the two covers come to rest with their flat faces 32, 33, 34 in corresponding faces. This means that a pack in the horizontal position will not roll away, and that packs can be safely stacked.

In order to prevent a roll 2 enclosed in the pack from being able to slide to some extent to and fro lengthwise in the tube, thus possibly causing damage to the end faces 5, the two bottoms 16 or 26 are each provided on the inside with an insert disc 40, made of an elastic material, such as foamed plastic. The already-mentioned possibility of damage to the end faces 5 of the rolls is not only prevented here, but the tolerance with which the tubes 7 are cut off from the long rolls of material supplied becomes less critical, while the greatly feared telescoping of a wound roll of sensitive material is also prevented.

To save material, the tongue 28 can be made internally hollow. It is, however, then possible to provide the walls 29 and 30 of the tongue 28 with screened openings, which are connected to the inside of the tube. If the cavity 31 of the tongue 28 is now made closable on the open side (not shown), it is possible to place, for example, a drying agent such as silica gel in the cavity.

I claim:

1. A package for light sensitive material wound on a core including a generally tubular body of rigid material, and end ring positioned on at least one end of said tubular body, said one end ring being provided with a pair of concentric spaced circular walls defining a groove therebetween configured to frictionally receive one end of the tubular body therewithin, retention means on one of said walls extending into said groove for retaining said ring on said body, a sealing recess on said one ring directed away from said groove and configured to receive sealing means therewithin, and closure means for each end of said tubular body, said closure means including centering means extending into said package body and said core a distance sufficient to position said light sensitive material centrally within said body and free of contact with the interior of said package and further including sealing means on at least one end of said package configured to cooperate with the sealing means on at least one of said end rings to provide a seal between said ring and said closure.

2. The package as defined by claim 1 wherein at least one of the closures on one end of the package includes interconnecting screw threads with the adjacent ring for selective engagement and disengagement of the closure with the package.

3. The package as defined by claim 1 wherein at least one of the closures on one end of the package includes interconnecting bayonet means with the adjacent ring for selective engagement and disengagement of the closure with the package.

4. The package as defined by claim 1 wherein one of the closure members is permanently fixed to the corresponding end ring on which it is mounted.

5. The package as defined by claim 1 wherein each closure includes a substantially hollow centering means extending into said container and said core.

6. The package as defined by claim 1 wherein said sealing means between said ring and said closure includes an outwardly directed groove on said ring and a cooperating internally directed tongue on said closure.

7. The package as defined by claim 1 wherein each closure member includes an octagonal periphery and the flat sides of the octagonal periphery are aligned on opposite ends of the container.

* * * * *